US005735685A

United States Patent [19]

Amaya-Orozco et al.

[11] Patent Number: 5,735,685

[45] Date of Patent: Apr. 7, 1998

[54] GAS INJECTOR FOR A BURNER IN A GAS COOKING STOVE AND METHOD OF MANUFACTURE

[75] Inventors: José Antonio Amaya-Orozco; Victor Esquivel-Guerrero, both of San Luis Potosi, Mexico

[73] Assignee: Vitromatic Comercial, S.A.DE C.V., San Luis Potosi, Mexico

[21] Appl. No.: 312,896

[22] Filed: Sep. 27, 1994

[30] Foreign Application Priority Data

Sep. 27, 1993 [MX] Mexico ..... 935927

[51] Int. Cl.[6] ..... B05B 9/00

[52] U.S. Cl. ..... 431/354; 239/600; 29/890.142

[58] Field of Search ..... 431/354, 355; 126/39 E; 29/890.15, 890.142, 890.143; 239/591, 600

[56] References Cited

U.S. PATENT DOCUMENTS 3,289,731 12/1966 Geber ..... 431/354
3,514,041 5/1970 Van Rooyen ..... 431/355
3,849,058 11/1974 Pankow ..... 431/354 X
4,953,534 9/1990 De Gouville et al. ..... 126/39 H

FOREIGN PATENT DOCUMENTS 26525517 4/1991 France ..... 239/600

*Primary Examiner*—Carl D. Price
*Attorney, Agent, or Firm*—Abelman, Frayne & Schwab

[57] ABSTRACT

The present invention is referred to a gas injector for a stove burner and its method of manufacture. The injector includes: a gas pipe located at the body of a domestic gas stove burner which itself includes: an area that is externally deformed with a semi-flattened out flange, near the end of the stated pipe which itself is attached to the burner; a threaded section on the internal part of the stated pipe, on top of the first area of the said deformed pipe; and, an upper flange which extends to the end of the pipe and does so angularly towards a greater diameter, preferably about a 45 degree angle relative to its axial shaft. A tubular body threaded on its outside and firmly coupled around the exterior surface of the pipe, between the upper flange and the exterior deformed area, and the said tubular body includes a lower flat support section which leans on the outside area of the deformed pipe; and a nozzle for gas that is directly coupled onto the internal part of the threaded section of the pipe so that it is positioned next to the housing of the aforementioned gas burner.

10 Claims, 1 Drawing Sheet

GAS INJECTOR FOR A BURNER IN A GAS COOKING STOVE AND METHOD OF MANUFACTURE

FILED OF THE INVENTION

The present invention is related with burners for gas stoves, and more specifically, to a gas injector that is used to feed gas, in an individual manner, to each one of the stove gas burners of domestic gas stoves.

BACKGROUND OF THE INVENTION

In the conventional gas stoves, the gas burners are formed by a group of burners, which are regularly assembled as a single body, which includes a head or upper cover where the gas is burned by combustion.

The body of the burners include two entry orifices (one for each burner), through which the gas is injected under pressure. The stated entry orifices of the body of the burners are connected to gas injectors that are placed on the back or front part of the stoves, which, when the same are opened by means of their respective valves, it causes a mixture of air-gas, to flow towards the upper part of the burner to be lit.

However, one of the main problems of the known stoves has to do with cleaning the same. When some liquid or food is spilled on the burners, it was necessary to take out a series of stove elements, such as the grill, the tray and the body of the burner.

Later, new stove designs came out which changes the design of the burners. The stated burners were placed, individually, on top of a plate placed on the upper part of the stove, which also served as a tray to facilitate the stove's cleaning in case of a spill of food or liquids.

Under this new concept, it was also necessary to reposition the gas injectors, which were individually placed under the body of each burner. These injectors were supported by an internal plate of the stove itself, and it was kept in place by attaching them to the plate of the upper part of the stove itself.

One of the injectors known of the previous art in the gas stoves was mainly formed by: a gas pipe that was placed to coincide with the body of a stove burner of domestic stoves; a tubular body with an outside thread which includes a flat, lower support section which rests on an internal plate of the stove itself; and, a nozzle for gas coupled by means of a thread to the upper and internal part of the tubular body which will be located to coincide with the housing of the gas burner. In this case, the coupling between the gas pipe and the tubular body is made by deforming the tubular body through pressure.

However, one of the problems with this type of injectors is that because of the coupling between the pipe and the tubular body placed underneath the internal support plate of the stoves, together with the structure or the body of the stove, forms a closed chamber, which in case of a leak at the coupling of the parts (pipe-body), the chamber can store domestic gas with the corresponding risk of an explosion.

Another design of the gas injector and burner can be cited by the assembly shown in the U.S. Pat. No. 4,953,534, dated Sep. 4, 1990, which was assigned to the Company named Sourdillon-Airindex. This patent shows an assembly of a gas burner of the extra flat type, which is placed above an upper cover or tray. This assembly includes the body of a burner which, itself, includes an expansion chamber. A tubular member which is coupled to the body of the burner extends vertically downward until it covers a gas injector located on the lower part, and it also positions the same coaxial, at the entrance of the air-gas mixture, in the body of the burner. The injector is supported freely by an additional structure that is placed underneath the upper cover.

Even though some problems have been briefly described pertaining to the previous art and design advances of stoves, the purpose of the present invention is, mainly, to simplify the design of the gas injector used in the stove gas burners, preventing the risk of stove explosions, as well as reducing the manufacturing and assembly cost of the same.

For this purpose, the gas injector, in keeping with the present invention, includes mainly: a pipe for gas placed to coincide with the body of a burner of domestic stoves, said pipe comprising: an exterior area that is deformed to adopt the shape of a flange or a semi-flattened shape, near the end of said pipe that coincides with the burner; a threaded section on the internal part of said pipe, placed above the first deformed area of the aforementioned pipe; and, an upper flange which extends the edge of the pipe, angularly towards a greater diameter, with the stated angle preferably around 45 degrees, relative to its axis. A tubular body with a thread on its outside is firmly coupled around the outside surface of the pipe, between the upper flange and the externally deformed area. Said tubular body includes a lower flat support section which rests on the deformed area of the pipe; and a nozzle for gas that is coupled directly in the internal part of the threaded section of the pipe, in order to be positioned to coincide with the housing of the gas burner.

OBJECTIVES OF THE INVENTION

It is therefore, a first objective of the present invention to provide a gas injector for stove burners which simplifies the design of the gas injectors known in the previous art.

Another objective of the present invention is to provide a gas injector for stove burners, which avoids leaks at the coupling of the parts, preventing thus the risk of an explosion through the accumulation of gas within the internal chambers of stoves.

An additional objective of the present invention is to provide a gas injector for stove burners which reduces the cost of manufacture and assembly of the same.

These and other advantages and additional objectives of the present invention will be evident to the experts in the field, as per the following detailed description of the same, and reference will be made to a specific embodiment of the invention using an illustrative method, which itself does not limit the scope of said invention.

DETAILED DESCRIPTION OF THE INVENTION

A specific embodiment of the invention, illustrated through the drawings which are attached, and which will serve to illustrate the same, and wherein reference numbers describe the same parts shown on the figures.

Figure 3:
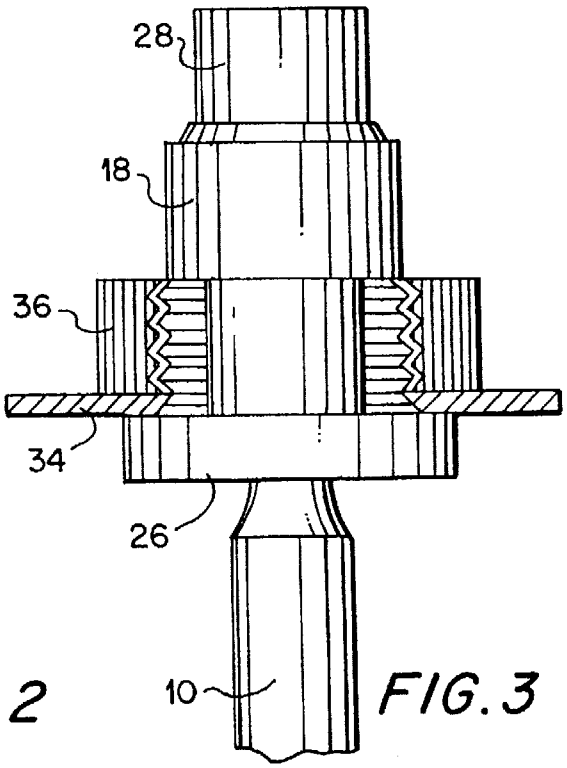
Figure 2:
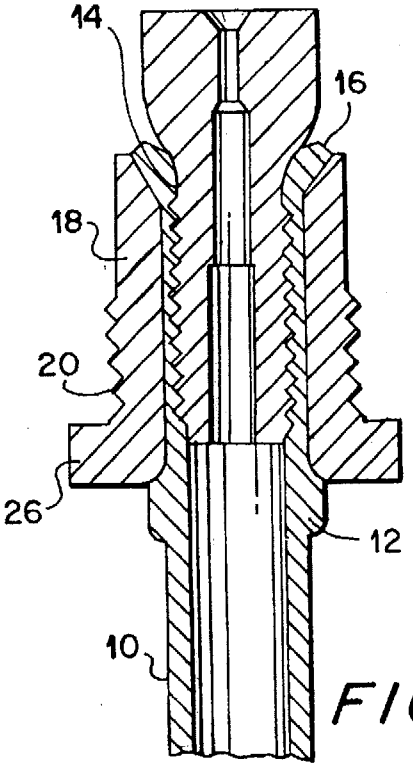
FIG. 2, is a similar view of FIG. 1, showing the coupled components of the injector; and, FIG. 3, is an elevated view of the gas injector, of the present invention, for gas stoves.
Figure 1:
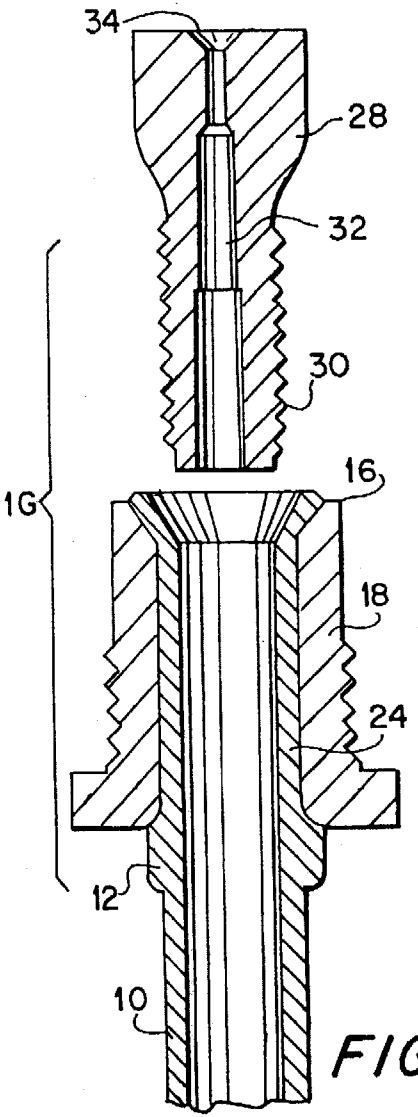
FIG. 1, is a cross section view, in a vertical position, showing an outline of the gas injector for stove burners of the present invention.

Making particular reference to FIGS. 1, 2, and 3, the gas injector IG of the present invention generally includes:

a pipe for gas (10) placed vertically to coincide with the lower part of the body of a stove burner for domestic gas stoves (not shown). Said pipe (10) includes, an externally deformed area which has the shape of a flange, or a semi-flattened shape, (12), near the end of stated pipe (10), which coincides with the burner (not shown). A threaded section (14) in the internal part of said pipe (10), above the first deformed area in the shape of a flange, or a semi-flattened shape (12); and, an upper flange (16) that extends to the mouth of the pipe (10), angularly towards a greater diameter, and the said angle preferably to be 45 degrees relative to its axial shaft.

A tubular body (18) with an exterior thread (20) on its lower part, which couples around the outer surface (24) of the end of pipe (10), between the upper flange (16) and the exterior deformed area (12). The said tubular body (18) includes a lower, flat support section (26) which rests on the deformed outside area (12) of pipe (10), as is clearly shown in FIGS. 1, 2, and 3.

And finally, a nozzle (28), which includes a threaded outside sector (30) which couples to the internal part of the internal section (14) of pipe (10) (FIG. 2), to be positioned to coincide with the housing of the gas burner (not shown). Said nozzle (28) includes a longitudinal orifice (32), through which the gas that comes from pipe 10 flows, and an exit orifice (34), to permit the flow of gas towards the body of the burner (not shown).

As can be observed in FIG. 3, the gas injector, is coupled to an internal plate (34), of a stove (not shown). The gas injector is located under the upper cover of fixed tray (not shown) of said stove. As can be seen in FIG. 3, the flat section (26) of the tubular body (18), is placed underneath the internal plate (34), while the tubular body (18), crosses said plate (34), and is attached by means of a nut (36), positioned over the internal plate (34).

Even though a specific embodiment of the gas injector IG for stove burners has been described, it is possible to carry out some modifications of the same. An alternative design for this gas injector IG is to eliminate the threaded section (14), located on the internal part of said pipe (10), as well as to eliminate the threaded section (30), of nozzle (28). In this case, the nozzle (28), would be inserted under pressure on the internal part of pipe (10).

In keeping with the above, the manufacturing method for a gas injector for stove burners comprising the stages of:

providing a pipe (10), for gas, made out of a ductile material;

deforming the pipe (10), externally around its edge, so that it adopts the shape of a flange or a semi-flattened shape (12), near the end of said pipe (10);

assembling a tubular body (18) with an external thread, around the outside surface of the pipe (10), above the deformed area of the pipe (12), said tubular body (18), including a lower flat section (26) which rests on the exterior deformed area of the pipe;

applying a deformation to the upper part of the pipe (10), until the mouth of pipe (16), is angularly widened to a larger diameter, preferably one having about a 45 degree angle relative to its axis to press and fix the tubular body (18) around the upper end of pipe (10); and, coupling a nozzle (28), for gas on the internal part of the pipe (10), by its upper part, which will coincide with the housing of a gas burner.

The method for the manufacture of a gas injector, wherein the pipe (10) is made out of a ductile material for gas is used, and the same includes the stage of providing, on one of its ends, a threaded section (14), in the internal part of the same.

The method used for the manufacture of a gas injector which includes the step of providing a threaded section (30), on a sector of the exterior part of the nozzle (28).

Finally it must be understood, by the experts in the field, that the present invention must be taken under an illustrative sense, but not one that would be limiting. Therefore, changes in the design and distribution of the parts that make up the present gas injector may be made. Consequently, the same changes will remain under the true spirit and scope of the present invention, wherein the following claims are made:

We claim:

1. A gas injector for a gas burner which comprises:

a pipe (10) said pipe (10) comprising an area externally deformed to adopt a semi-flattened shape (12), near an upper end of said pipe (10), and an upper external flange (16) which is a part of the upper and of said pipe (10) and extends angularly from the remainder of the upper end of the pipe (10) towards a larger diameter than the remainder of the upper end of the pipe (10), said upper external flange (16) being formed by deformation of said part of the upper end of the pipe (10);

a tubular body (18), firmly coupled on an external section of the pipe (10), between the upper flange (16) and the semi-flattened shape (12), said tubular body (18) including a lower section (26) which rests on said semi-flattened shape of the pipe (10), and a threaded section (20) on an external section of said tubular body (18);

a nut (36) attached on the threaded section (20) of said tubular body (18); and a unitary nozzle member (28) coupled inside an interior section of the pipe (10).

2. The gas injector for a gas burner, as claimed in claim 1, wherein the pipe (10) comprises a threaded section in the interior part of said pipe, above the semi-flattened shape (12) of said pipe (10).

3. The gas injector for a gas burner, as claimed in claim 1, wherein the nozzle member (28) comprises a threaded section (30) on an external part of said nozzle member (28).

4. The gas injector for a gas burner, as claimed in claim 1, wherein the nozzle member (28) is connected under pressure in the interior section of the pipe (10).

5. The gas injector for a gas burner, as claimed in claim 1, wherein the upper flange (16) extends angularly towards a larger diameter at approximately an angle of 45 degrees.

6. A method for the manufacture of a gas injector for a gas burner comprising the steps of:

a) providing a pipe (10) of a ductile material for gas;

b) deforming the pipe (10) externally around its edge, forming a semi-flattened shape (12), near an upper end of said pipe (10);

c) assembling a tubular body (18) around the upper end of said pipe (10), said tubular body (18) having an external thread around its exterior surface and a flat lower section which rests above the semi-flattened shape (12), of the pipe (10);

d) applying a deformation to an upper end of the pipe (10) until the upper end of the pipe (10) is angularly widened to a larger diameter to press and fix the tubular body (18) around the upper end of the pipe (10); and e) coupling a unitary gas nozzle member on an interior part of the pipe (10).

7. The method for the manufacture of the gas injector, as claimed in claim 6, wherein providing the pipe of step a)

includes the step of providing a threaded section in an interior part of said pipe.

8. The method for the manufacture of the gas injector as claimed in claim 6, wherein the unitary nozzle of step e) comprises a threaded section about an exterior section of said nozzle.

9. The method for the manufacture of the gas injector as claimed in claim 6, wherein the step of coupling the unitary nozzle on an interior part of the pipe comprises connecting the nozzle under pressure.

10. The method for the manufacture of the gas injector as claimed in claim 6, wherein the step of coupling the unitary nozzle on an interior part of the pipe comprises threading the unitary nozzle inside the pipe.

* * * * *